United States Patent [19]

Shim

[11] Patent Number: 4,539,925

[45] Date of Patent: Sep. 10, 1985

[54] BI-DIRECTIONAL FEED DOG MECHANISM FOR SEWING MACHINE

[76] Inventor: Peter B. S. Shim, 99 Midland Crescent, SE., Calgary, Alberta, Canada, T2X 1N8

[21] Appl. No.: 615,599

[22] Filed: May 31, 1984

[30] Foreign Application Priority Data

Jun. 9, 1983 [CA] Canada ..... 430021

[51] Int. Cl.[3] ..... D05B 27/02

[52] U.S. Cl. ..... 112/314

[58] Field of Search ..... 112/314, 303, 158 R, 112/308

[56] References Cited

U.S. PATENT DOCUMENTS

| | | | |
|---|---|---|---|
| 1,354,783 | 10/1920 | Seymour | 112/303 |
| 2,064,221 | 12/1936 | Roseman | 112/308 |
| 2,311,222 | 2/1943 | Galkin | 112/309 |
| 2,652,797 | 9/1953 | Amman | 112/314 |
| 2,731,929 | 1/1956 | Ayres | 112/309 |
| 2,911,929 | 11/1959 | Caldwell | 112/303 X |
| 2,976,830 | 3/1961 | Vigorelli | 112/158 R |
| 3,004,503 | 10/1961 | Erlichman | 112/160 |
| 3,096,737 | 7/1963 | Bono | 112/308 |
| 4,187,794 | 2/1980 | Ross et al. | 112/308 |

FOREIGN PATENT DOCUMENTS

| | | | |
|---|---|---|---|
| WO83/10796 | 5/1983 | PCT Int'l Appl. | 112/303 |

*Primary Examiner*—Werner H. Schroeder
*Assistant Examiner*—Andrew M. Falik

[57] ABSTRACT

An adaptor for sewing machines permits a fabric to be fed past the stitch forming area in a choice of two perpendicular directions. The adaptor includes feed dog means and a support plate for said feed dog means. A first connector assembly produces horizontal backward and forward reciprocating movements of the feed dog and support plate and a second connector arm assembly produces a horizontal sideways reciprocating movements of the feed dog and support plate. A rocker rod assembly mounted below the feed dog and support plate includes a pair of axially aligned rocker rods, one of the rocker rods being a powered rod and the other being a driven rod. The driven rod is operatively connected to the first connector arm assembly and the powered rod is operatively connected to the second connector arm assembly by way of a freely rotatable sleeve mounted on the powered rod. A clutch mechanism includes a slideable member adapted in one position to operatively connect the two rocker rods thereby producing backward and forward reciprocating movements of the feed dog and in a second position to disconnect the two rocker rods and to operatively connect the freely rotatable sleeve to the powered rod thereby producing sideways reciprocating movements of the feed dog.

5 Claims, 4 Drawing Figures

BI-DIRECTIONAL FEED DOG MECHANISM FOR SEWING MACHINE

BACKGROUND OF THE INVENTION

1. Field of the Invention

This invention relates to sewing machines in general, and more particularly to a work feeding mechanism which permits a fabric or garment to be fed past the stitch forming area in a choice of two perpendicular directions.

2. Description of the Prior Art

Sewing machines having mechanical elements for effecting fabric feeding to the right or left sides of a normal line of feeding are known in the prior art. Such machines frequently employ cams which impart fabric feeding motion to the feed dog through mechanical arrangements. For example, U.S. Pat. No. 3,004,503 describes a sewing machine with a secondary independent feed actuator that will effect reciprocating lateral movement of the material during its longitudinal path of movement through the stitch forming area of the machine.

It is the object of the present invention to provide a simple mechanism which will permit fabric to be sewed either in the normal straight ahead feed direction of the sewing machine or in a direction perpendicular to the normal feed direction.

SUMMARY OF THE INVENTION

This invention relates to sewing machines of the usual type including a rocker rod for producing horizontal forward and back reciprocating movement of a feed dog for moving a fabric or garment past a stitch forming area.

The novel features of the present invention include in combination, feed dog means; support plate means for said feed dog means; a first connector arm means for producing horizontal forward and backward reciprocating movements of the feed dog and support plate; a second connector arm means for producing a horizontal sideways reciprocating movement of the feed dog and support plate and a rocker rod assembly mounted below the feed dog and support plate. This rod assembly includes a pair of axially aligned rocker rods, one of these rods being a powered rod and the other being a driven rod, the driven rod being operatively connected to the first connector arm and the powered rod being operatively connected to the second connector arm by way of a freely rotatable sleeve mounted on the powered rod. A clutch mechanism is provided including a slideable member adapted in one position to operatively connect the two rocker rods, thereby producing forward and backward reciprocating movements of the feed dog and in a second position to disconnect the two rocker rods and to operatively connect the freely rotatable sleeve to the powered rod thereby producing sideways reciprocating movement of the feed dog.

The clutch slideable member is fixed against rotation on the powered rod by way of a slideable spline and groove. Thus, the slideable member always rocks simultaneously with the powered rocker rod. In one position this slideable member operatively engages a mating member fixed to the end of the driven rod and in the other position operatively engages with the freely rotatable sleeve.

This provides a very simple and easy to install mechanism for adapting a normal sewing machine to one having the capability of sewing either in the normal straight ahead feed direction or perpendicular to the normal direction.

Referring to the accompanying drawings in which corresponding and like parts are designated throughout the several views by the same reference characters, FIG. 1 is an isometric view of a rocker rod assembly including the features of the present invention;

Figure 1:
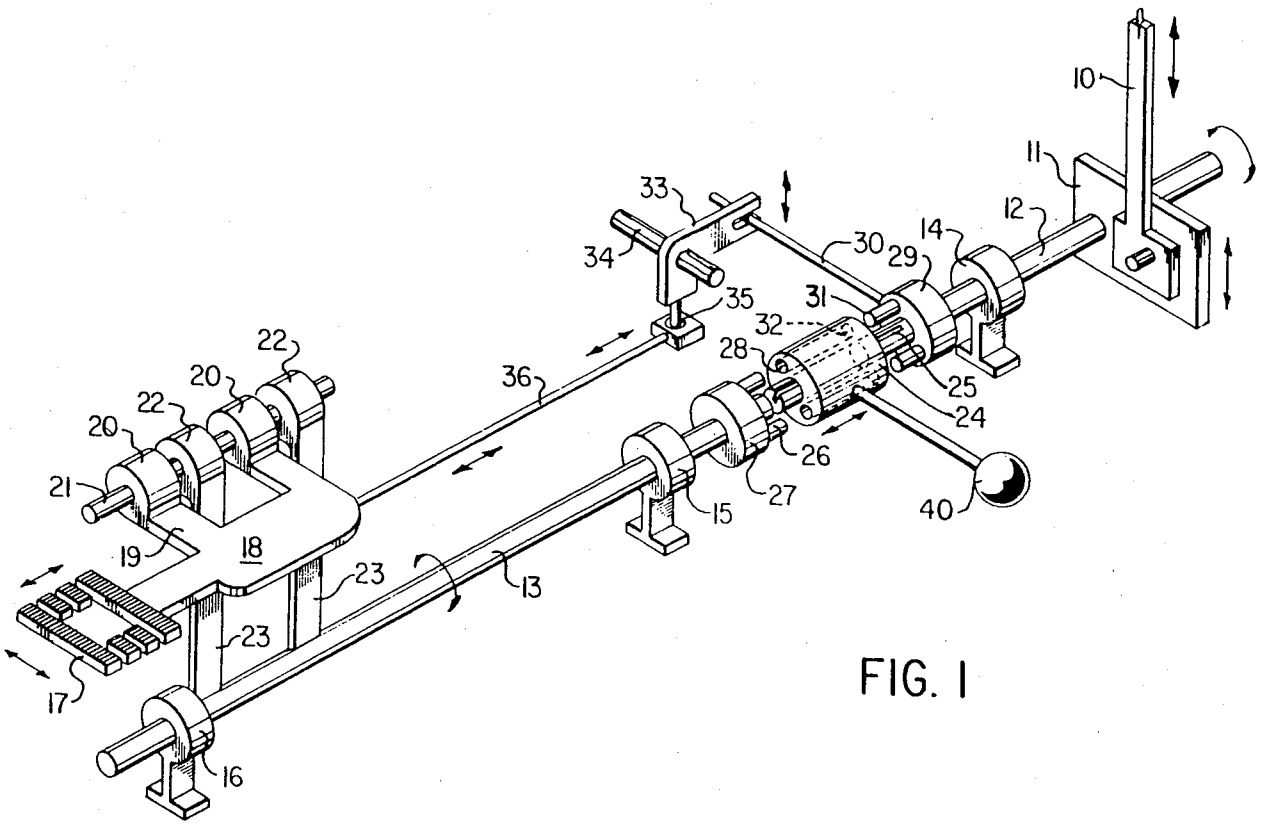
Figure 2:
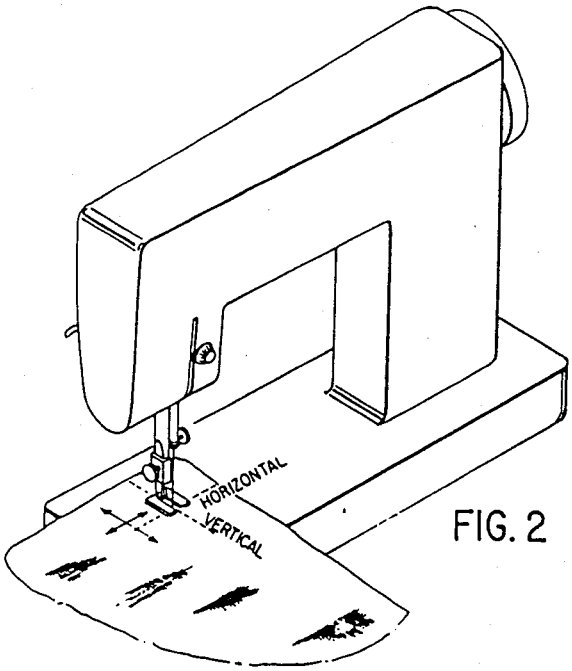
FIG. 2 is an isometric view of a sewing machine with both sewing directions illustrated.
Figure 3:
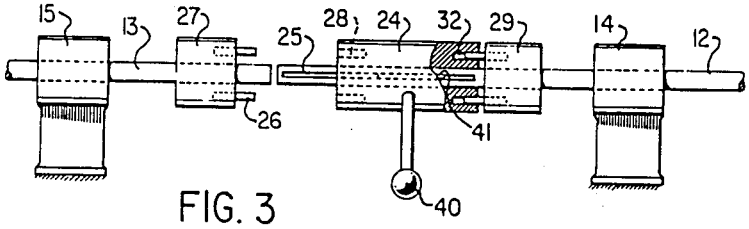
FIG. 3 is an isometric view of the clutch portion in one engaging position and FIG. 4 is an isometric view of the clutch portion in the other engaging position.
Figure 4:
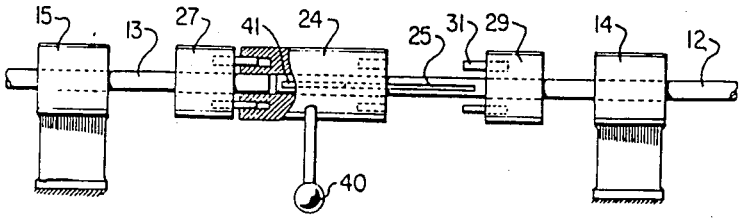

Referring now to the drawings, and more particularly to FIG. 1 thereof, a sewing machine includes a usual crank arm 10 connected via connector 11 to a powered rocker rod 12. Axially adjacent this rocker rod 12 is a second rocker rod 13. These rocker rods are rotatably supported in the base of a sewing machine by means of support bushings 14, 15 and 16.

The machine includes a typical feed dog 17 which is mounted to a support plate 18. This support plate includes a U-shaped portion with a pair of projecting arms 19. The ends of these arms 19 include a pair of bushings 20 within which are mounted a slideable rod 21. This rod 21 also mounted within a further pair of bushings 22 mounted on the ends of a pair of upstanding arms 23 which connect to driven rocker rod 13. Thus, when rod 13 is caused to rock, it swings arms 23 in a backward and forward motion, thereby providing a backward and forward oscillating motion to feed dog 17.

The driven rod 13 is actuated by connection to powered rod 12 via slideable clutch member 24. It will be seen that rod 12 includes a slot 25 and the slideable member 24 includes a spline which slides within slot 25 thereby fixing the slide member 24 against rotation on rod 12. In other words, slideable member 24 must always rotate simultaneously with the rocking of rod 12.

To cause the feed dog 17 to move in a horizontal backward and forward motion, the slide member 24 is moved by a handle 40 to the left so that the pins 26 projecting from the end of fixed disc member 27 on rod 13 engage the holes 28 in the end of the slideable member. With the pins 26 in the holes 28, the slide member 24 being activated by the rocking action of rod 12 simultaneously rocks rod 13.

Also mounted on rod 12 is a freely rotatable sleeve member 29 which has rigidly fixed thereto an arm member 30. The sleeve member 29 also has pins 31 adapted to engage holes 32 in the adjacent end of slideable member 24. Thus, when the slideable member is in operative engagement with the sleeve 29, this sleeve and the connected arm 30 are set into a reciprocating motion. The arm 30 engages a pivotal arm 33 mounted on a pivot 34. The lower end of the pivot arm 33 connects to a connector 35 on the end of a rod 36 which in turn connects to support plate 18. Thus, the upward and downward reciprocating action of arm 30 causes the lower end of pivot arm 33 to swing backward and forward, thereby providing a reciprocating action longitudinally to the arm 36, which in turn causes support plate 18 to reciprocate in the same direction sliding on rod 21 and thereby creating a sideways reciprocation of feed dog 17.

It will be evident that the modification that forms the present invention is adaptable to any regular sewing machine that utilizes a rocker rod to produce horizontal forward and back reciprocating movement of a feed dog.

I claim:

1. In a sewing machine, in combination, feed dog means; support plate means for said feed dog means; a first connector arm means for producing horizontal backward and forward reciprocating movements of the feed dog and support plate; a second connector arm means for producing a horizontal sideways reciprocating movements of the feed dog and support plate; a rocker rod assembly mounted below said feed dog and support plate, including a pair of axially aligned rocker rods, one of said rocker rods being a powered rod and the other being a driven rod, said driven rod being operatively connected to said first connector arm and said powered rod being operatively connected to said second connector arm by way of a freely rotatable sleeve mounted on said powered rod; a clutch mechanism including a slideable member adapted in one position to operatively connect the two rocker rods thereby producing backward and forward reciprocating movements of the feed dog and in a second position to disconnect the two rocker rods and to operatively connect said freely rotatable sleeve to said powered rod thereby producing sideways reciprocating movements of the feed dog.

2. The combination of claim 1 in which the clutch slideable member is mounted on said powered rocker rod and is fixed against rotation thereon by means of a slot and spline.

3. The combination of claim 2 in which the operative engagement between the slideable member and the driven rocker rod or sleeve is in the form of projecting pins and mating holes.

4. The combination of claim 2 in which said second connector arm means between the sleeve and the feed dog comprises a projecting arm fixed to said sleeve, a pivotal rocker arm having one end thereof actuated by said projecting arm and being connected at the other end thereof to a rod which is fixed to the feed dog support plate.

5. The combination of claim 4 in which the feed dog support plate is slideably mounted on a support rod which rod is supported by arms extending upwardly from said driven rocker rod.

* * * * *